US005562309A

United States Patent [19]

Brink et al.

[11] Patent Number: 5,562,309

[45] **Date of Patent: * Oct. 8, 1996**

[54] PRINT FOLDER WITH PRE-APPLIED DOUBLE STICK TAPE

[75] Inventors: Thomas J. Brink, Conover, N.C.; Jack B. Keable, Hiltonhead, S.C.

[73] Assignee: Waldorf Corporation, St. Paul, Minn.

[ * ] Notice: The term of this patent shall not extend beyond the expiration date of Pat. No. 5,407,203.

[21] Appl. No.: 308,260

[22] Filed: Sep. 19, 1994

Related U.S. Application Data

[63] Continuation-in-part of Ser. No. 100,570, Jul. 30, 1993, Pat. No. 5,407,230.

[51] Int. Cl.[6] ..... B42D 1/00

[52] U.S. Cl. ..... 281/15.1; 281/21.1; 281/29; 281/31

[58] Field of Search ..... 281/15.1, 21.1, 281/29, 30, 31, 37, 48; 402/70, 73, 75, 78; 40/359; 493/947; 229/82, 84

[56] References Cited

U.S. PATENT DOCUMENTS

| | | | |
|---|---|---|---|
| 924,094 | 6/1909 | Meyers . | |
| 1,114,596 | 10/1914 | Dustan . | |
| 1,774,215 | 8/1930 | Weinthrop . | |
| 2,281,452 | 4/1942 | Ottinger . | |
| 3,734,396 | 5/1973 | Cowan . | |
| 3,933,294 | 1/1976 | Meenan et al. . | |
| 4,109,850 | 8/1978 | Meenan et al. . | |
| 4,275,517 | 6/1981 | Blanchard . | |
| 4,991,767 | 2/1991 | Wyant . | |
| 5,038,503 | 8/1991 | Goldberg . | |
| 5,060,847 | 10/1991 | Angus . | |
| 5,236,226 | 8/1993 | Sheffield | 402/8 |
| 5,407,230 | 4/1995 | Brink et al. | 281/21.1 |

*Primary Examiner*—Willmon Fridie, Jr.
*Attorney, Agent, or Firm*—Schwegman, Lundberg, Woessner & Kluth, P.A.

[57] ABSTRACT

The present invention is a folder, particularly adapted for containing and viewing photographic prints or the like. The folder includes a front cover and a rear cover foldably connected to the front cover at a spine or binding area. The folder includes a selectively releasable closure and an adhesive binding region for removably securing the contents in the folder. The invention also encompasses a flat blank for forming the folder.

25 Claims, 10 Drawing Sheets

PRINT FOLDER WITH PRE-APPLIED DOUBLE STICK TAPE

RELATED APPLICATIONS

This application is a continuation-in-part of application Ser. No. 08/100,570, filed Jul. 30, 1993, U.S. Pat. No. 5,407,230.

TECHNICAL FIELD

The present invention relates to folders, portfolios or the like. More particularly it relates to a folder for containing and viewing photograph, i.e. prints, wherein the folder includes an integral securing means for securing the prints in the folder and a reusable closure.

BACKGROUND OF THE INVENTION

U.S. Pat. No. 4,991,767 (to Wyant) discloses a portfolio having a front cover, a rear cover hingedly connected to the front cover and an inner pocket for securing items such as paper sheets within the folder. The Wyant portfolio is adapted to display photographs by being provided with a transparent film overlaying cutout sections in the front cover. There is no suggestion in the Wyant patent about how to provide a lockable reclosure means to hold the portfolio closed to protect the contents, nor does the Wyant portfolio provide any means for viewing a series of photographs arranged in manner similar to the pages of a book. U.S. Pat. No. 1,774,215 (to Weinthrop) discloses a somewhat similar display folder, but again, there is no disclosure of a closure for holding the folder closed, and the Weinthrop folder does not include a way to mount photographs or the like in a page-like arrangement.

U.S. Pat. No. 5,060,847 (to Angus) discloses a fairly typical film processing envelope including generally rectangular back and front panels, a closure flap secured to the back panel and a relatively shallow open-top pouch. The contents, developed film or negatives, must be removed from the envelope in order to be viewed. While the Angus reference discloses that a closure flap may be provided so that the envelope can be reclosed, the flap includes a repositionable adhesive which, in time, may tend to loose its adhesive qualities, creating the danger that the contents may fall out of the envelope. The Angus-type envelopes generally may not be durable enough for long-term storage and reuse.

Other arrangements for containing and viewing photographs are disclosed in U.S. Pat. Nos. 5,038,503 (to Goldberg) and 4,275,517 (to Blanchard). The Goldberg assembly is an "accordion" arrangement wherein a number of photographic prints are arranged in edge to edge relationship for receipt in a carton container or box. The Blanchard invention comprises a photographic mount including a frame and a cover hinged to the frame, but it is only capable of mounting a single photograph for viewing and there is no recloseable locking feature disclosed.

U.S. Pat. No. 3,734,396 (to Cowen) discloses a ticket envelope having a front panel, a rear panel and a ticket-receiving pocket, but there is no disclosure of a binding means nor a releaseably lockable closure.

Of course, tab and tab-receiving slot closures are known and are well represented by U.S. Pat. No. 924,094 (to Myers) and the closure for a flexible receptacle as disclosed in U.S. Pat. No. 2,281,452 (to Ottinger). Such tab and slot closures are useful, but there is no suggestion in either of these two references about adapting such closures to a portfolio-like folder for viewing or displaying a series of photographs. U.S. Pat. No. 1,114,596 (to Dustan) discloses a loose-leaf holder including a tab arrangement to hold together the blank sections forming the holder; but there is no suggestion about how to provide a book-like spine or binding arrangement.

U.S. Pat. Nos. 3,933,294 and 4,109,850 (both to Meenan et al.) disclose a one-piece file folder with a rigid spine. While the '850 patent discloses a pocket for containing papers, including a locking tab for slidably expanding or contracting the pocket according to the amount of papers added to the pocket or taken therefrom, there is no suggestion about how to mount plurality of photographs in a page-like manner for viewing, nor is there a suggestion about providing a reusable, releaseably lockable closure for holding the file folders closed.

While all the above-noted patents represent improvements in portfolios and folders, certain problems associated with containing and viewing photographs or prints are not addressed.

One such problem is that a folder for containing a valuable photographic prints should be able to be secured in a closed position, yet be openable easily and conveniently. Once opened, the folder should allow a viewer to view a series of photographs conveniently, ideally in a page or leaf-like manner. It would also be preferable that the prints could be removed from the folder and replaced therein without damage, and that negatives from which the prints are developed could be safely contained in the same folder.

Accordingly, a recloseable folder for containing and viewing photographs, prints or the like, which is easy to open and lockably reclose and which adequately protects the contents yet allows the removal and replacement of the contents, would be a decided improvement over known folders or portfolios.

SUMMARY OF THE INVENTION

The present invention is a folder, particularly adapted for containing and viewing photographs, prints or the like. The folder includes a front cover and a rear cover foldably connected to the front cover at a spine or binding area. The folder includes an integral interior pocket and recloseable clasp. The binding area includes adhesive securing means for removably securing the contents in the folder.

The invention also encompasses a fiat blank that may be folded and secured into the preceding folder configuration. The blank may be made from the suitable caliper of paperboard or other suitable material.

To form the blank into its folder configuration, the interior pocket forming panel thereof is folded inwardly to overlie the rear panel. Next, a pair of structural support panels associated with a free edge of the front cover panel are folded inwardly to strengthen the front cover panel and to form a rolled folder edge. The structural panels carry the base of the clasp which is formed by two parallel nicked-out cuts. The clasp receiving keyway or slit is located along the fold line associated with the interior pocket forming flap. A double-sided adhesive tape, or other suitable adhesive, is applied to the spine or binding region located between the front and rear cover panels.

In use, the folded-up blank is provided in a generally flat condition, and a film processor or user removes the release layer from the double-sided tape along the spine, places the edge of the intended contents against the tape and then folds the front and rear panels together. Prior to folding the front panel over the intended contents, now held in place by the adhesive along the spine, the clasp is freed from the front panel by lifting outwardly, breaking the nicks in the cut lines. The covers can then be closed and the clasp removably inserted in the clasp receiving slit. Negatives or other material associated with the photographs or prints such as identifications may be placed in the interior pocket prior to closing the cover.

The present invention encompasses alternative embodiments wherein the interior pocket is eliminated or both the front and rear covers are reinforced by a single reinforcement panel substantially equal to the covers in surface area. In such embodiments the clasp may be defined in such panels and lifted free along cut lines or it may be formed as a separate feature. Another feature which may be incorporated into the print folder of the present invention is a "Velcro" or hook and loop fabric arrangement associated with the closure clasp. Another optional feature which may be provided is a viewing window associated with either the front or rear cover, preferably the front. Yet another alternative embodiment includes a supplemental plastic binding spine clip.

An object of the present invention is to provide a durable, recloseable folder for containing delicate photographs, prints, instant Polaroid-type pictures, trading cards (including sports cards), wallet size pictures (such as school pictures) and the like. The folder may be used to contain, organize and view virtually any card-like items or material, and enables such material to be stored in the folder, viewed conveniently without removal, and removed and replaced without damage.

Another object of the present invention is to provide a lockably recloseable package that is easy to open and reclose yet permits the transport, storage, organization, and display or viewing of prints and print negatives conveniently.

An advantage of the present invention is that it adequately protects photographic materials, prints or the like, allows prints and print negatives to be kept together and facilitates arranging prints or photographs in a book-like fashion by date or occasion.

Another advantage of the present invention is that the contents, i.e., photographs, can be inserted easily, removed without damage, and reinserted at any time.

Other objects and advantages of the present invention will become more fully apparent and understood with reference to the following specification and to the appended drawings and claims.

DETAILED DESCRIPTION OF THE PREFERRED EMBODIMENT

Figure 4:
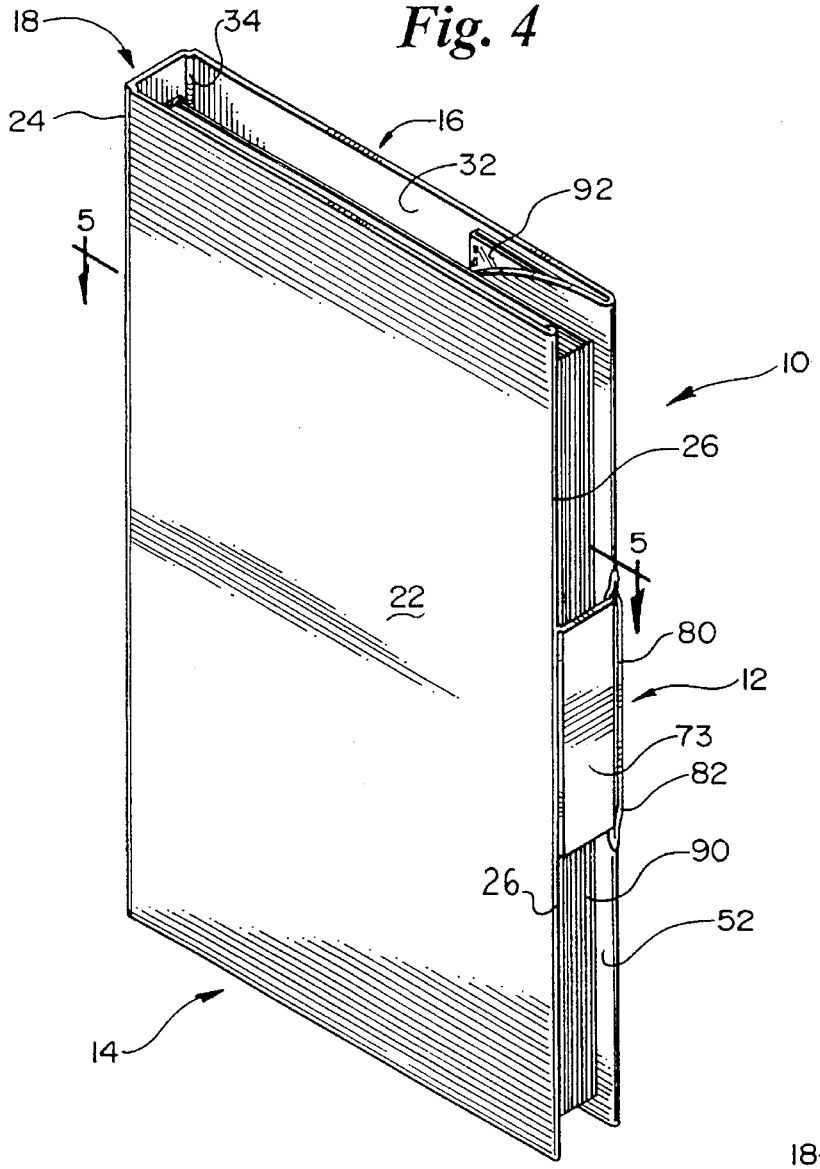
FIG. 4 is a perspective view depicting the present invention fully formed, with contents in place, and lockably closed.

As best seen in FIG. 4, a completed book-like folder 10 in accordance with the present invention includes a relockable closure 12, a front cover 14, a rear cover 16, and a binding or spine region 18. The contents of the folder 10 are received and held in the folder 10 in a page-like configuration.

Figure 1:
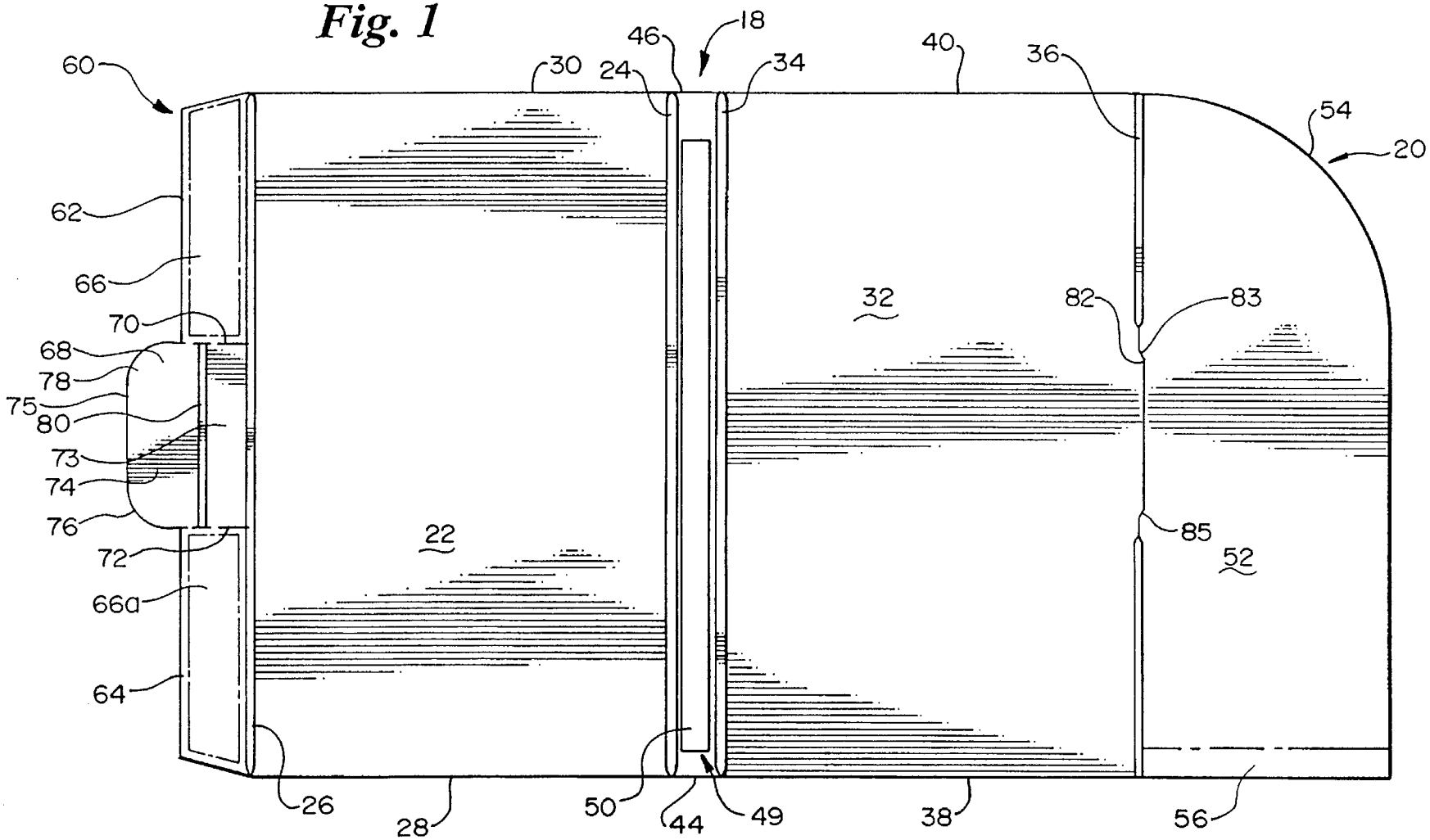
FIG. 1 is a view of the blank from which the folder of the present invention is formed, and shows the die cut profile thereof.

FIG. 1 depicts the inside surface of a blank 20 forming, in accordance with the present invention, the folder 10 depicted in FIG. 4. In the drawings, double lines indicate scores forming fold lines. Single solid lines indicate cuts or free edges, except where otherwise indicated.

The blank 20 has a generally rectangular front wall forming panel 22 having two opposed edges defined by fold lines 24, 26, a bottom free edge 28 and a top free edge 30.

A generally rectangular rear cover forming panel 32 substantially corresponds in size and surface area to the front cover forming panel 22. The rear cover forming panel 32 is defined by two opposed parallel fold lines 34, 36, a bottom free edge 38 and a top free edge 40. The fold line 34 is generally parallel to the fold line 24, but spaced therefrom.

The binding or spine area 18 is defined by parallel fold lines 24, 34 and by a bottom free edge 44 and a top free edge 46. The fold lines 24, 34 are spaced apart from each other a predetermined distance to provide a binding adhesive region 49 therebetween. The adhesive region 49 accommodates a double-sided adhesive tape of the type represented by that denoted "Tesafix 4965", manufactured by tti of New Rochelle, N.Y. The tape includes an adhesive 48 and a removable overlying release-layer 50.

An interior pocket forming panel 52 is foldably connected to the rear cover forming panel 32 along the edge thereof formed by the fold line 36. The pocket forming panel 52 is co-extensive with the rear cover forming panel 32 along the fold line 36 and includes a rounded corner region 54. The pocket forming panel 52 carries an adhesive region 56 at its bottom edge.

A reinforcing structural panel, indicated generally at 60, is foldably connected to the front cover forming panel 22 along the edge thereof formed by the fold line 26. The structural panel is substantially co-extensive with the length of the fold line 26 and includes an upper panel 62 and a lower panel 64, each carrying an adhesive region 66, **66*a*, respectively. The adhesive regions 56, 66, 66*a*** may be an activatable adhesive or a contact-type adhesive.

Between the upper and lower structural panels 62, 64, the front cover forming panel 22 carries a male clasp tab 68. The clasp tab 68 is foldably connected to the front cover forming panel 22 at fold line 26, and is defined by a pair of parallel nicked-out cut lines, an upper cut line 70 and a lower cut line 72. Alternatively, the cut lines 70, 72 can extend completely through the edges of the tab 68. The tab 68 has a base region 73, a tongue 74 and a leading edge 75, generally parallel to the fold line 26, with rounded corners 76, 78. A short flexure fold line 80 extends across the width of the tab 68 and is generally parallel to the fold line 26. The fold line 80 is spaced from the fold line 26 a distance approximately equal to the distance between the fold lines 24, 34. Another component of the reclosure clasp 12 is a female tab receiving slit 82. The slit 82 is generally co-linear with the fold line 36 between the pocket forming panel 52 and the rear cover forming panel 32. The slit 82 has tapered ends 83, 85 formed by non-collinear terminal regions of the slit 82 to facilitate locking the folder 10 and, like the tab 68, is generally centered between the upper and lower free edges of the blank 20.

Figure 2:
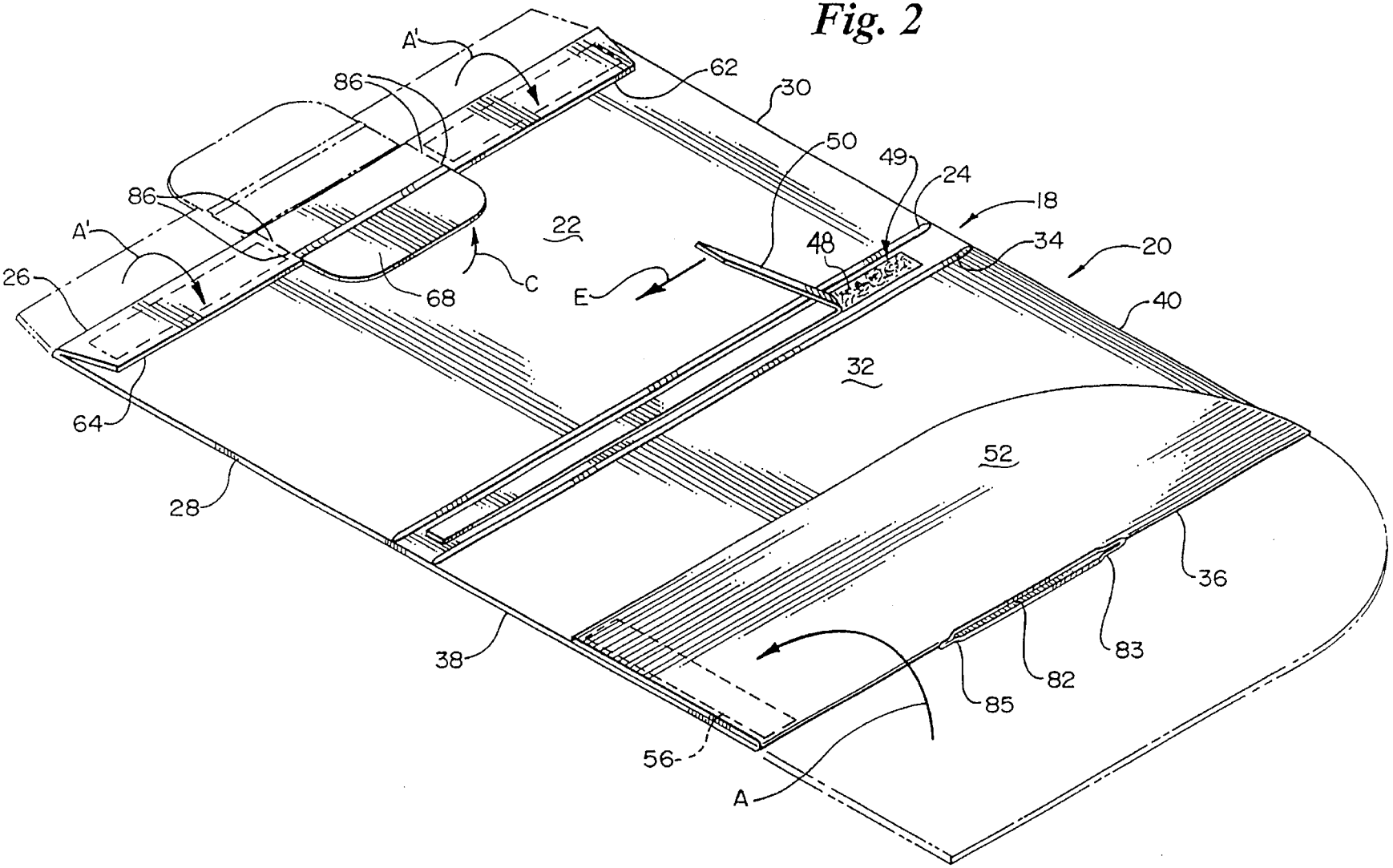
FIG. 2 is a perspective view of the present invention showing the fold up of the blank and the preparation of the folder of the present invention for receiving contents.

FIG. 2 depicts the fold up or forming sequence for forming the blank 20 into the folder 10. First, 180 degree folds are made at fold lines 36 and 26, in the direction of arrows. A and A', respectively, whereby the pocket forming panel 52 is brought into overlying relationship with the rear cover forming panel 32. Similarly, the structural reinforcement panels 62, 64 and the clasp 68 are brought into overlying relationship with the front cover forming panel 22. Prior to such folding the adhesive areas 56, 66 and **66*a* may be activated or, alternatively, a contact adhesive may be applied. Thus, the interior pocket forming panel 52 and structural panel 60 are fixed in the positions depicted in FIG. 2. The blank 20 may be supplied to a purchaser such as a film processor or a photographer, in the condition just described. FIG. 2 also depicts the steps an end user of the folder 10 undertakes having purchased the blank 20. Specifically, the release layer 50 protecting the adhesive 48 in the adhesive binding region 49 along the spine 18 is removed by pulling it free in the direction of arrow E. The clasp tab 68 is lifted in the direction of arrow C, rupturing the nicks 86 holding it in place and reverse folding it 180 degrees outwardly to the position depicted in phantom in FIG. 2, its position before the structural panels were folded inwardly. Alternatively, if the nicks 86 are eliminated, the folder can be provided to the end user with the tab 68 in the position shown in FIG. 3**.

Figure 3:
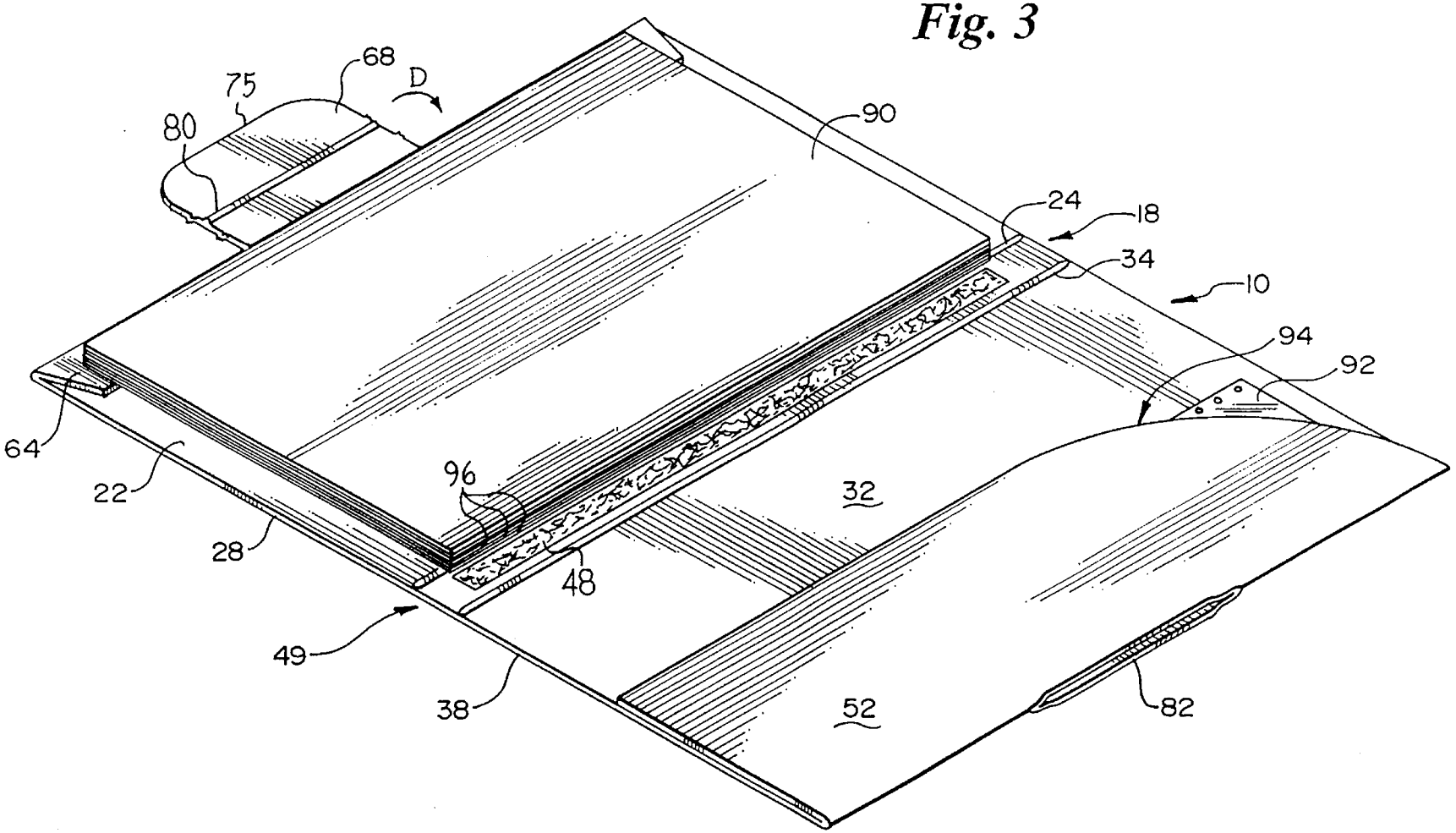
FIG. 3 is a perspective view of the present invention depicting the position of its intended contents, including the contents of the internal pocket.
Figure 5:
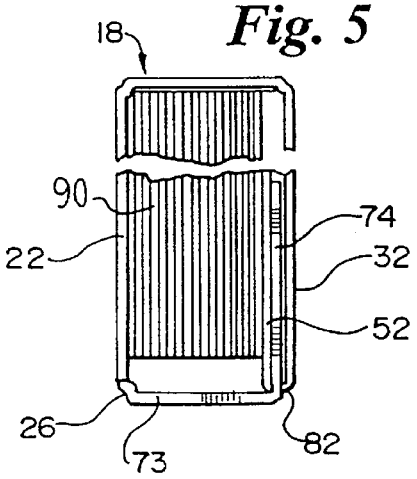
FIG. 5 is a cross-sectional view of the present invention taken along line 5—5 of FIG. 4.

FIG. 3 depicts the placement of a plurality of photographs or other sheet material 90 and some associated materials such as negatives 92 in the folder 10 of the present invention. The photographs 90 are arranged in a stack whereby they have a page-like appearance. The negatives or other materials are slidably received in the interior pocket 94. The folder 10, particularly the front and rear forming panels are folded toward each other about the fold lines 24, 34. This folding brings the edges 96 of the stacked photographs 90 into contact with the adhesive 48 affixing them in place against the adhesive. The clasp tab 68 can be folded in the direction of arrow D along the fold line 80 to facilitate the insertion of the free edge 75 into the slit 82. Referring to FIGS. 4 and 5, the fold line 80 also helps to create a secure closure with the covers being parallel because the span between the fold line 80 and 26 is substantially equal to the spine or binding area between the fold lines 24 and 34. The clasp tab 68 is frictionally held within the slit 82 (and between the rear wall 32 and the pocket forming panel 52) by contact with the inside surfaces of the pocket 94.

Figure 6:
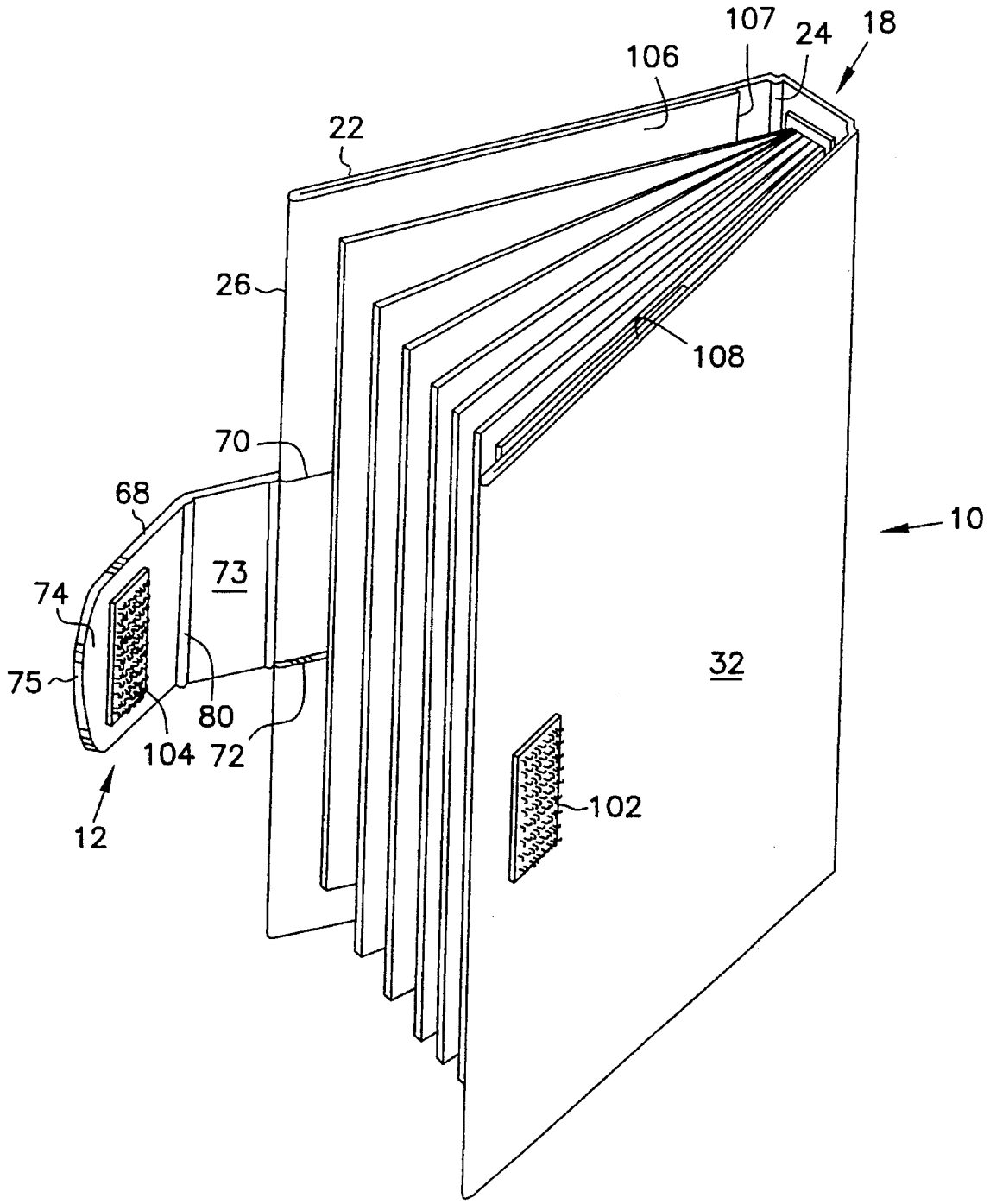
FIG. 6 is a perspective view of an alternative embodiment of the present invention wherein a "Velcro"-type hook and loop locking means and front and rear cover stiffening or reinforcement panels are provided.

Modified forms or alternative embodiments of the folder 10 of the present invention are depicted in FIGS. 6–13. Referring to FIG. 6, in one alternative embodiment the folder 10 is substantially as described above, but a supplemental locking arrangement comprising a "Velcro"-type, complimentary hook and loop fabric arrangement is added to the relockable closure 12. Specifically, one of the complimentary members of the hook and loop arrangement, member 102 is secured to the exterior of the rear cover 32 of the folder 10 near the free edge thereof. The other tape member 104 is adhered to the inside surface of the tongue portion 74 of the tab 68. Obviously, the position of the hook and loop members 102, 104 may be reversed since they are complimentary. Another feature of the embodiment of the folder 10 depicted in FIG. 6 is a front cover reinforcement or stiffening panel 106 for increasing the rigidity and durability of the cover 22. The panel 106 basically comprises an extension of the reinforcing structural panel indicated generally at 60 in FIG. 1. The stiffener panel 106 is foldably connected to the front panel 22 along foldline 26 and has a surface area substantially equal to that of the front cover 22, but the free edge 107 of the panel 106 is spaced from the fold line 24 defined by one side of the binding region 18. The relockable closure 12, particularly the tab 68, is formed in the stiffener panel 106 by extending the cut lines 72, 70 as necessary. The rear cover 32 of the embodiment of the folder 10 depicted in FIG. 6 also includes an inside stiffener panel 108 which replaces the internal pocket 94 formed by the pocket forming flap 52. The stiffener panel 108 basically comprises an extension of the pocket forming panel 52. Both panels 106, 108 are adhered to the respective covers 32, 22. Because the closure 12 makes use of the hook and loop arrangement, the slit 82 may be eliminated in the embodiment depicted in FIG. 6. However, by appropriately locating the adhesive between the panel 108 and the rear cover 32, the tab 68 may be accommodated and the tab/slit arrangement depicted in FIG. 1 could be used.

Figure 7:
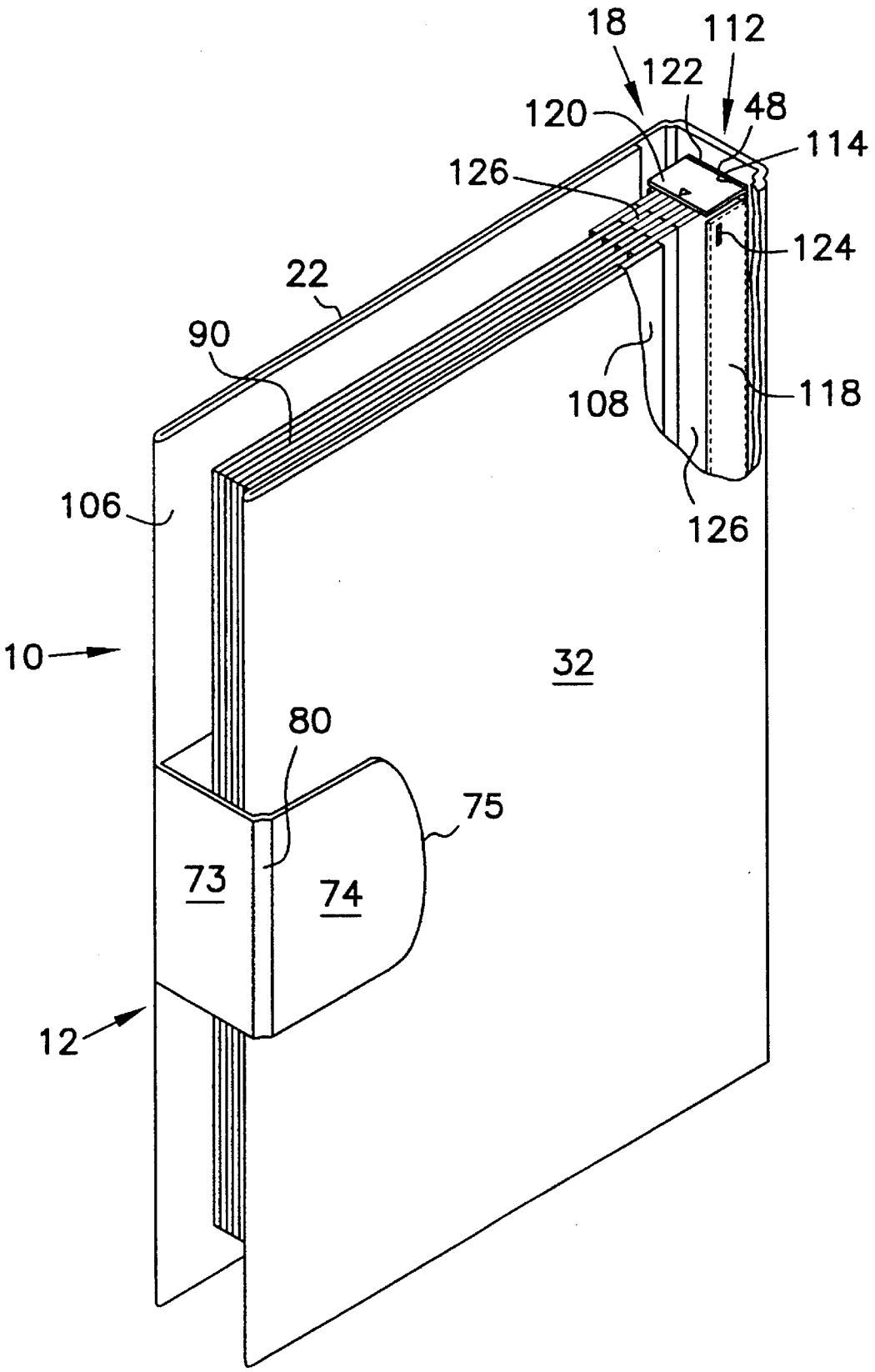
FIG. 7 is a perspective view, with portions cut away, depicting the alternative embodiment of FIG. 6 further modified to include a supplemental clip spine.
Figure 7A:
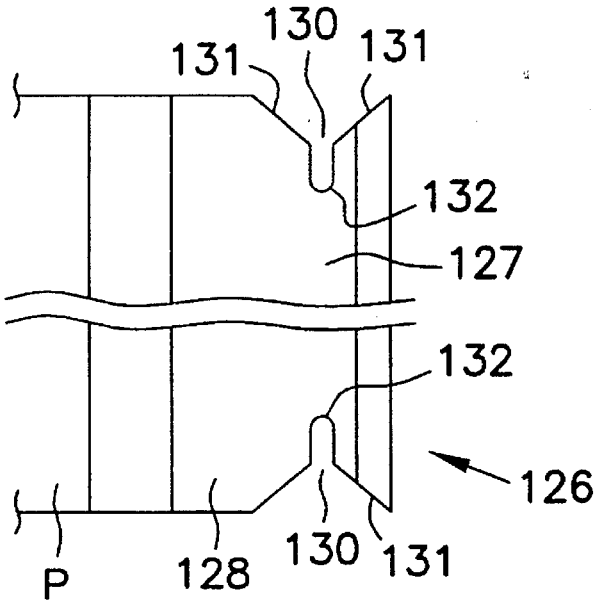
FIG. 7*a* depicts one of the paper and tape binding strips for use with the supplemental clip spine.
Figure 8:
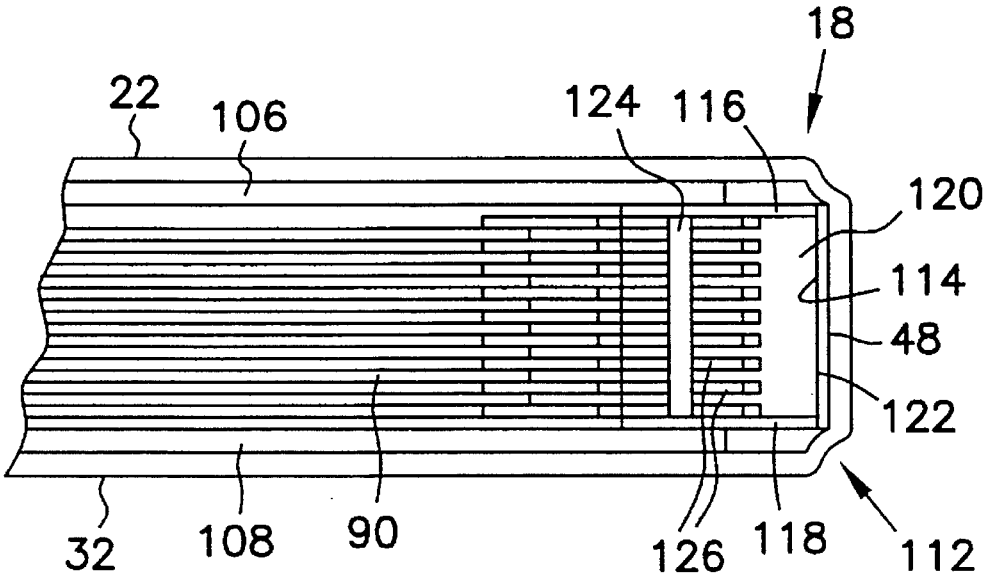
FIG. 8 is a fragmentary top plan view showing the clip spine in a print folder modified with front and rear cover stiffening panels.

FIGS. 7 and 8 depict another modified form of the folder 10 of the present invention wherein a supplemental plastic clip spine 112 is used with the folder 10. The clip spine 112 includes a substantially continuous rear wall 114 which is adhered to the adhesive 48 in the binding region 18 of the folder 10. Sidewalls 116, 118 extend from the rear wall 114 of the clip 112. At each end of the clip 112, substantially identical pivotal end walls 120 (only the upper end wall 120 is visible) are hingedly coupled to the rear wall 114 along a living hinge 122. The ends 120 carry a perpendicular flange 124 which, when the ends 120 are closed, extend toward each other and are parallel to the rear wall 114. The clip 112 is designed to receive a plurality of supplemental binding strips 126 (depicted in FIG. **7*a*). The binding strips 126 comprise an elongated paper base strip 127 carrying a piece of clear Tesa tape 128, the adhesive side (or sides) of which may be protected by a release layer (not shown) prior to use. The ends of the base strip 127 have cutout notches 130 extending inwardly toward each other along the length of the base strip 127 for receiving the flange 124 when the ends 120 are closed. Each notch 130 has tapered or angled shoulders 131 leading to the straight-sided, innermost portion 132, which extends generally along or parallel to the longitudinal axis of the base strip 127. In use, as shown in FIGS. 7, 7***a* and 8, the tape portion 128 of the binding strips 126 is adhered to the back edge of a photograph or other item "p". Then the strip 126 and photo combination is inserted between the side walls until the free edge of the base 127 abuts or is near the rear wall of the clip 112 and the ends 120 are closed, capturing the paper portion 127 of the strip 126 therebetween and holding the photograph or other print material "p" in book form in the folder 10 (as shown in FIG. 7). A suitable clip spine and binding strip arrangement is one of the type manufactured by Qualex, Inc., a Kodak company.

Figure 9:
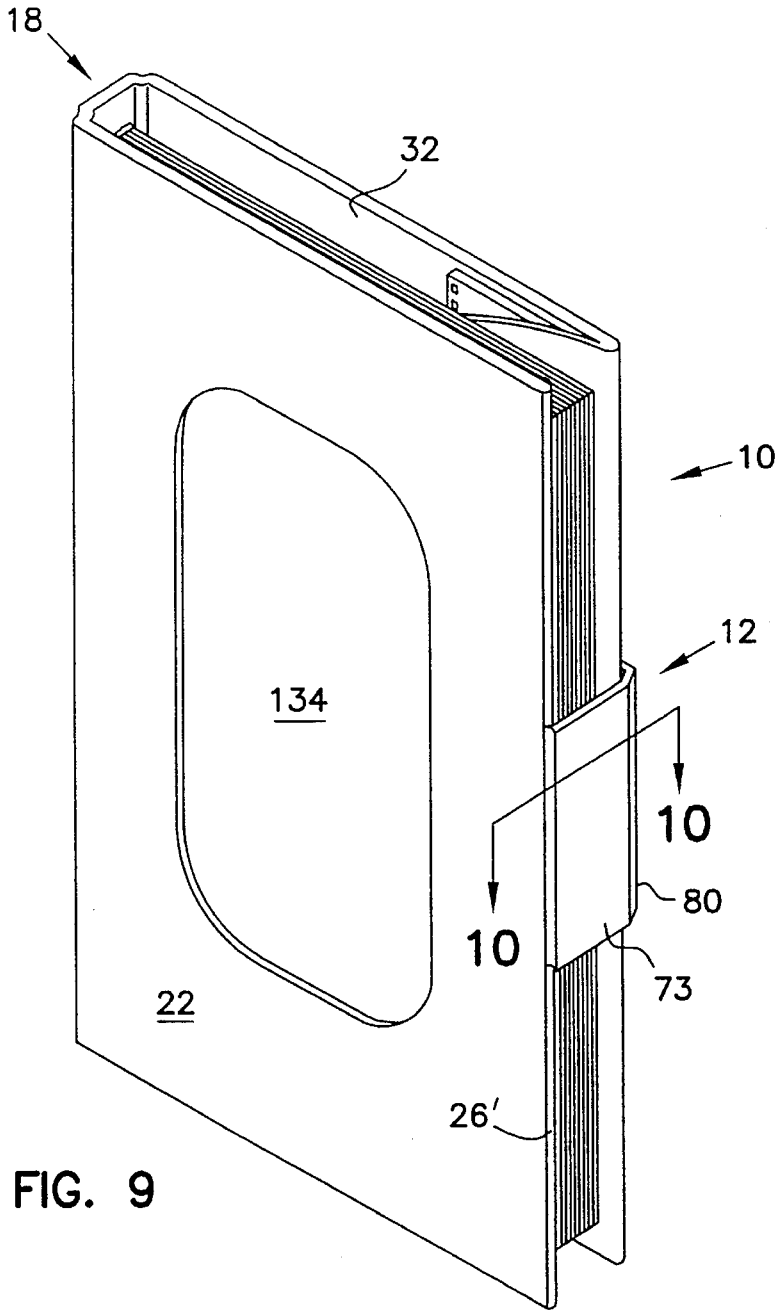
FIG. 9 is a perspective view of another alternative embodiment of the present invention, wherein a photograph display opening is associated with at least one of the front and rear covers.
Figure 10:
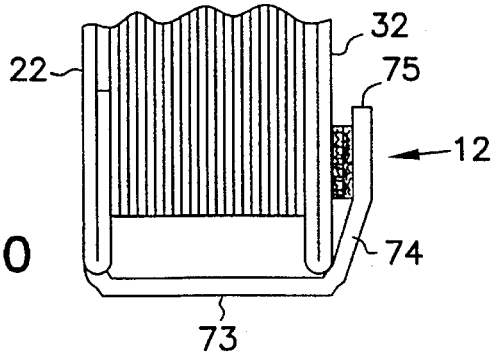
FIG. 10 is a cross-sectional view taken along line 10—10 of FIG. 9.
Figure 11:
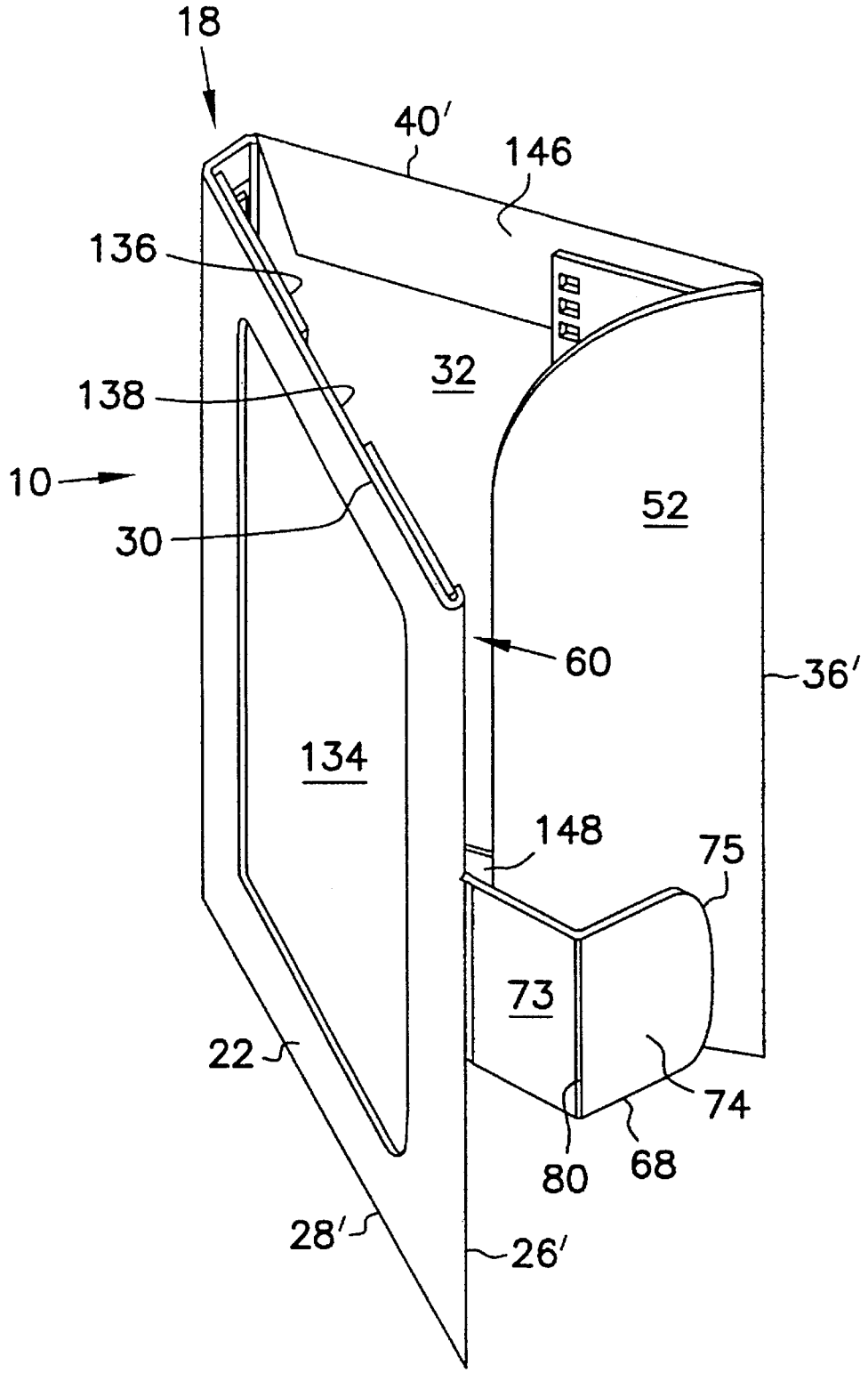
FIG. 11 is a perspective view of a third alternative embodiment of yet another embodiment of the present invention wherein the front cover has a display window, and wherein all but one of the edges of the print folder are rolled.
Figure 12:
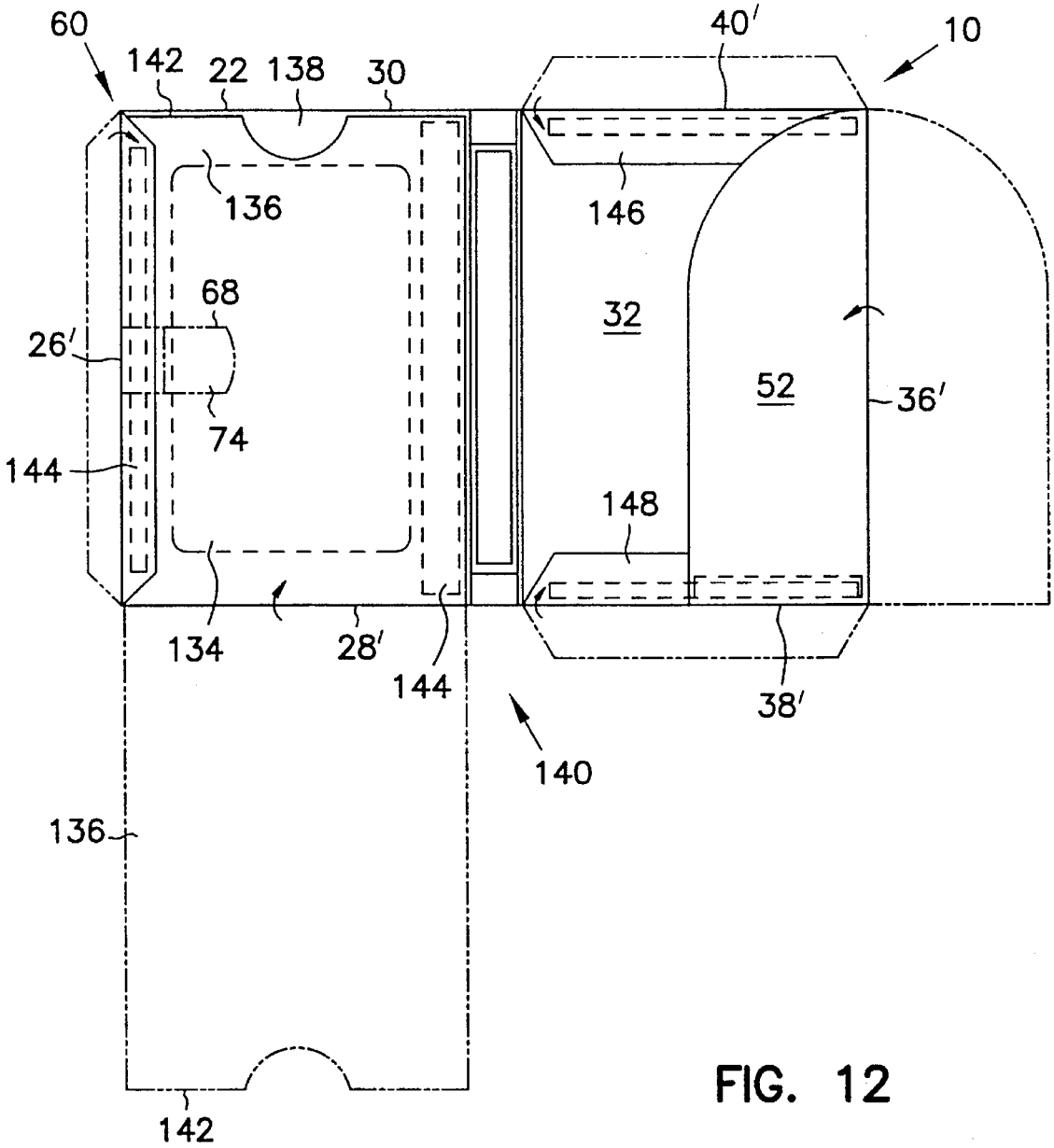
FIG. 12 is a plan view of the inside of embodiment depicted in FIG. 11 with portions in phantom to depict the blank, and the folding and gluing of the blank, for forming the embodiment.

FIGS. 9–13 depict another modified embodiment of the folder 10 of the present invention wherein the closure 12 includes a "Velcro"-type hook and loop arrangement (as shown in FIG. 10) and wherein one of the covers of the folder 10, the front cover 22 as shown in FIG. 9, includes a photograph or print display window or opening 134. The embodiment of the folder 10 of the present invention depicted in FIGS. 9–13 has many features in common with the embodiment depicted in FIG. 6 and these features are commonly numbered. However, as shown in FIGS. 11 and 12, the folder 10 may include additional supplementary flaps to strengthen the folder 10 and to provide finished, rolled edges on all the edges of the folder except one.

Referring to FIG. 12, a plan view of the inside of the blank 140 for forming the embodiment of the folder 10 depicted in FIGS. 9–13 is depicted. The front cover 22 is provided with an stripped out opening window 134, shown in phantom in FIG. 12, and a display pocket forming panel 136 is foldably connected to the front cover 22 along the bottom edge thereof formed by a foldline 28' corresponding to the free edge 28 of the cover 22. The pocket forming panel 136 has a surface area substantially equal to that of the front cover 22 and includes a finger slot 138 along its free edge 142. The pocket forming panel 136 or the inside of the front cover is provided with adhesive regions 144 for securing it in place as shown in FIG. 12 to provide a backing wall for the opening 134 and to create a pocket between the front wall 22 and the panel 136. With continued reference to FIG. 12, in contrast to the sharp free single layer edges 40, 28, 38 of the embodiment of the folder 10 (as depicted in FIG. 1), two of these edges 38', 40' are rolled or finished by providing minor top and bottom flaps 146, 148 foldably associated with the back cover panel 32. The other rolled edge 28' is rolled by the foldable connection between the panel 136 and the front cover 22. As in the folder and blank depicted in FIGS. 1–5, the edges 36' and 26' are rolled by virtue of the folding of the pocket forming panel 52 and the structural support panel 60.

Figure 13:
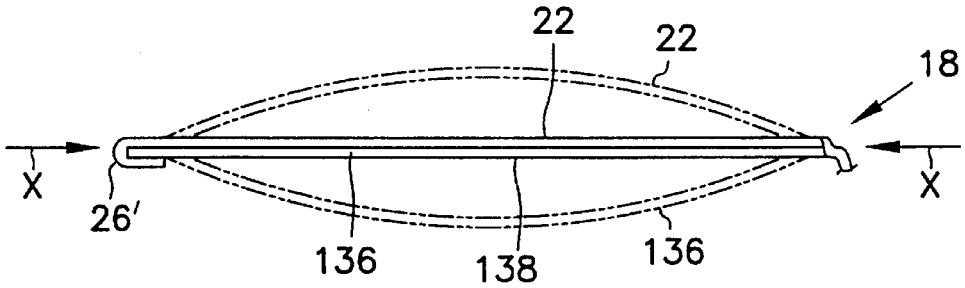
FIG. 13 is a fragmentary top plan view depicting how the cover with a display window may be manipulated so a photograph can be inserted.

FIGS. 11 and 13 depict the modified embodiment of FIGS. 9–13 fully formed wherein the top and bottom flaps 146 and 148 are folded in beneath the pocket forming panel 52 and wherein the pocket forming panel 136 has been folded upwardly to underline the structural panel 60, leaving an open foldable edge along the top edge 30 of the folder 10. FIG. 13 depicts the opening of the pocket formed by the front cover 22 and the pocket forming panel 136. The front cover is grasped on the spine region 18 and the edge 26' and pressure is applied in the direction of arrows "x". This closes the front cover 22 and causes the pocket forming panel 136 to bow outwardly toward the position depicted in phantom in FIG. 13, opening the pocket for receiving a photograph, print or the like. When the folder 10 is released, the natural resiliency of the front cover 22 and the pocket forming panel 136 cause it to flatten, capturing the photo, print or the like between the front cover 22 and the cover pocket forming panel 136.

The present invention could be changed by changing the shape of the internal pocket 94 or the shape of the front and rear panels 22, 32, e.g., the corners thereof could be rounded. An additional pocket (not shown) could be provided on the front cover 22 by extending the structural panels 62, 64. Additionally, divided pockets may be provided by layering pocket forming panels or by using fold-up dividers. A spring-type clip having two side members biased toward each other to contact each side of a photograph or print and grip it, or a spiral or ring binding mechanism may be used with or instead of the binding clip 112. Of course, the folder 10 could be provided with interior or exterior graphics or designs.

Although the description of the preferred embodiment has been presented, various changes including those mentioned above could be made without deviating from the spirit of the present invention. It is desired, therefore, that reference be made to the appended claims rather than to the foregoing description to indicate the scope of the invention.

What is claimed is:

1. A folder for contents such as photographs or the like comprising;

a binding region defined by two parallel side edges and two, spaced free edges generally perpendicular to said side edges;

a first cover foldably connected to one of the side edges and a second cover foldably connected to the other of the side edges, each cover having a pair of free edges and an outer edge generally parallel to said side edges;

means in the binding region for selectively securing, removing and resecuring the contents in the folder; and a selectively releasable closure including a closure tab foldably connected to one of the first and second covers along a tab fold line along the outer edge of that one of the first and second covers, said tab carrying one of two complimentary hook and loop fabric members, the second of the fabric members being carried by the other of the first and second covers.

2. The folder of claim 1, wherein said second of the fabric members is carried on the exterior of the other of the first and second covers.

3. The folder of claim 1, wherein one of the first and second covers includes a viewing window.

4. The folder of claim 3, wherein said window is generally centrally located in the first cover.

5. The folder of claim 3, wherein said folder includes a supplemental spine clip removably attached to said means for selectively securing, removing and resecuring said contents.

6. The folder of claim 5, wherein said supplemental spine clip comprises a clip body selectively attachable to said means for selectively securing, removing and resecuring said contents and a plurality of clip tape members, one joined to a photograph and the like, and each joined photograph and the like and clip being removably received in said clip body.

7. The folder of claim 5, wherein said folder includes at least one reinforcement panel connected to one of the first and second covers.

8. The folder of claim 7, wherein a first and a second reinforcement panel are foldably connected to the outer edge of the front and rear covers, respectively.

9. The folder of claim 8, wherein said first and second reinforcement panels have a surface area substantially equal to the surface area of the first and second covers.

10. A folder for containing contents such as photographs and the like comprising:

a binding defined by two parallel side edges and two, spaced free edges generally perpendicular to said side edges;

a front cover with a generally central opening for viewing one of the photographs and the like, said front cover foldably connected to one of the side edges, and a rear cover foldably connected to the other of the side edges, each cover having a pair of free edges and an outer edge generally parallel to said side edges;

means associated with the binding for selectively securing, removing and resecuring the contents in the folder; and a selectively releasable closure means for releaseably closing the folder.

11. The folder according to claim 10, wherein said closure means comprises a closure tab foldably connected to the front cover along a tab fold line collinear with the outer edge of the front cover, said tab carrying one of two complimentary hook and loop fabric members, the second of said members carried on said rear cover, said folder including an integral, interior pocket foldably connected to the rear cover along a fold line generally collinear with the outer edge thereof, said closure tab including a closure base and an adjacent closure flap foldably connected to the closure base along a flap fold line, said flap fold line being parallel to said tab fold line and said closure base being defined by the region between said flap and tab fold lines, the distance between said parallel edges and between said flap and tab fold lines being substantially equal.

12. The folder of claim 10, wherein said folder further comprises a supplemental spine clip attached to said means for selectively securing, removing and resecuring the contents.

13. The folder of claim 12, wherein said supplemental spine clip comprises a clip body removably attached to said means for selectively securing, removing and resecuring the contents and a plurality of clip tape members, each joined to a photograph and the like, and each joined photograph and the like and clip being removably received in said clip body.

14. The folder of claim 10, wherein said folder includes a reinforcement and pocket forming panel foldably connected to one of the free edges of the front cover.

15. The folder of claim 14, wherein said reinforcement and pocket forming panel has a surface area substantially equal to the surface area of the front cover.

16. The folder of claim 15, wherein said folder includes at least another reinforcement panel foldably connected to one of the free edges of the rear cover.

17. A folder for containing contents such as photographs and the like comprising:

a binding region defined by two parallel side edges and two, spaced free edges generally perpendicular to said side edges;

a front cover foldably connected to one of the side edges, and a rear cover foldably connected to the other of the side edges, each cover having a pair of free edges and an outer edge generally parallel to said side edges;

means for selectively securing, removing and resecuring the contents in the folder comprising a contents receiving means for removably receiving the contents and adhesive means for selectively securing, removing and resecuring the contents receiving means in said binding region;

a selectively releasable closure means for releasably closing the folder; and wherein the contents receiving means comprises a clip body removably attached to said adhesive means and a plurality of clip tape members, one joined to a photograph and the like, and each joined photograph and the like and clip being removably received in said clip body.

18. The folder according to claim 17, wherein the adhesive means includes an adhesive layer and a removable release layer overlying the adhesive layer.

19. The folder of claim 18, wherein said folder includes a reinforcement and pocket forming panel foldably connected to one of the free edges of the front cover, said reinforcement and pocket forming panel having a surface area substantially equal to the surface area of the front cover, and at least another reinforcement panel foldably connected to one of the free edges of the rear cover.

20. A single-piece blank for forming a folder for containing photographs or the like comprising:

a binding forming panel defined by two parallel fold lines and two spaced free edges generally perpendicular to the fold lines;

a first wall forming panel foldably connected to the binding forming panel along one of said two parallel fold lines and a second wall forming panel foldably connected to the binding forming panel along the other of said two parallel fold lines, each of said first and second wall forming panels having a pair of free edges and an outer edge generally parallel to the two parallel fold lines, one of said first and second wall forming panels having an opening for viewing one of the photographs or the like;

a closure means for releaseably closing the folder operably connected to one of the first and second wall forming panels and operably connectable to the other of the first and second wall forming panels; and means associated with the binding forming panel for selectively securing, removing and resecuring the photographs or the like in the folder.

21. The blank according to claim 20, wherein the pair of free edges of the first and second wall forming panels includes a first free edge generally collinear with one of the free edges of the binding forming panel and a second free edge generally collinear with the other free edge of the binding forming panel.

22. The blank according to claim 21, wherein the blank includes a backing panel foldably connected to one of the free edges of the first wall forming panel, said backing panel being foldable into generally parallel relation with the first and second wall forming panels when said blank is folded into the folder.

23. The blank according to claim 22, wherein said closure means includes a closure tab is foldably connected to one of the first and second wall forming panels along the outer edge thereof and a tab receiving means carried by the other one of the first and second wall forming panels.

24. The folder according to claim 23, wherein said means for removably securing includes an adhesive means retaining sufficient adhesive strength throughout the life of the folder to facilitate said selective securing, removing and resecuring.

25. The blank according to claim 24, wherein the closure tab is foldably connected to one of the first and second wall forming panels along a tab fold line and includes a closure base and a closure flap foldably connected to the closure base along a flap fold line, said flap fold line being parallel to said tab fold line and said closure base being defined by the region between said flap and tab fold lines, wherein the distance between said two parallel fold lines defining said binding forming panel and between said flap and tab fold lines is substantially equal.

* * * * *